US006142412A

United States Patent [19]

De Sa et al.

[11] Patent Number: 6,142,412

[45] Date of Patent: Nov. 7, 2000

[54] HIGHLY ACCURATE LONG RANGE OPTICALLY-AIDED INERTIALLY GUIDED TYPE MISSILE

[76] Inventors: Erwin M. De Sa, 4830 N. Valley View Rd.; Clyde R. Hanson, 1500E Paseo DL Zorro, both of Tucson, Ariz. 85718

[21] Appl. No.: 09/255,216

[22] Filed: Feb. 22, 1999

[51] Int. Cl.[7] ..... F41G 7/30; F42B 15/01

[52] U.S. Cl. ..... 244/3.16; 244/3.11; 244/3.14; 244/3.15; 244/3.19

[58] Field of Search ..... 342/62, 63; 244/3.1, 244/3.11, 3.13, 3.14–3.17, 3.19, 3.2, 3.21, 3.22

[56] References Cited

U.S. PATENT DOCUMENTS

| | | | |
|---|---|---|---|
| 3,631,485 | 12/1971 | Beazell, Jr. | 244/3.13 X |
| 3,796,396 | 3/1974 | Crovella | 244/3.14 |
| 3,964,695 | 6/1976 | Harris | 244/3.16 |
| 5,308,022 | 5/1994 | Cronkhite et al. | 244/3.14 |

*Primary Examiner*—Bernarr E. Gregory
*Attorney, Agent, or Firm*—David W. Collins; Andrew J. Rudd; Glenn H. Lenzen, Jr.

[57] ABSTRACT

An optically-aided, inertially guided missile. The inventive missile includes a receiver for accepting guidance commands from a source located on an independent frame of reference relative to the missile and providing a first signal in response thereto. A filter is mounted on the missile for processing the first signal and providing a second signal in response thereto. The filter outputs commands to a navigation system which provides missile guidance commands in a conventional manner. In the illustrative implementation, the filter is a Kalman filter configured to eliminate the effects of gunner jitter and optical guidance system noise thereby significantly improving missile terminal performance at long ranges. In the illustrative implementation, the navigation system includes an inertial sensor assembly. The navigation system outputs a signal representative of missile-to-target cross track position and velocity in response to outputs from the sensor assembly and the filter. A guidance law is used by the system to compute missile acceleration commands in response to the missile-to-target cross track position and velocity. Thereafter, fin control commands are generated by an autopilot in response to the missile acceleration commands in a conventional manner.

15 Claims, 4 Drawing Sheets

HIGHLY ACCURATE LONG RANGE OPTICALLY-AIDED INERTIALLY GUIDED TYPE MISSILE

BACKGROUND OF THE INVENTION

1. Field of the Invention

The present invention relates to missiles. More specifically, the present invention relates to optically-aided missiles.

2. Description of the Related Art

Tube launched, optically-tracked, wire-guided (TOW) type missiles, Stinger type missiles and other such optically-aided type missiles in service today typically use launcher mounted optical instruments for missile guidance. Typically the gunner places cross-hairs of the Optical Guidance System (OGS) on the target and pulls the trigger. In fractions of a second, the missile comes into the OGS's field-of-view and the OGS's tracking algorithms begin tracking the missile and measuring the missile's angular displacement to the OGS's cross-hairs. The angular displacement measurement is then used in accordance with a guidance law by a navigation system and an autopilot to guide the missile to the target.

Conventional optical guidance systems were designed for short missile standoff ranges. The accuracy of conventional missiles degrades as range-to-target increases. This is due to the fact that a small angular error in the OGS measurement produces a large position error at long ranges. The angular measurement errors are caused by OGS boresight errors, as well as tracker noise and gunner motion. The OGS boresight errors are caused by optical misalignments and are expensive to abate. Consequently, weapon system performance of conventional optically guided missiles at long ranges is limited by the position error effects of OGS tracker noise and gunner motion.

Unfortunately, longer standoff ranges will be required in the future and current guidance systems are not expected to meet the projected terminal guidance (miss distance) accuracy requirements of same.

Another drawback of the weapon systems described above is that the launcher has to continuously measure and uplink the line-of-sight measurements to the missile to ensure airframe stability and terminal performance. These systems have little tolerance for launcher dropouts. This imposes excessive burdens on the optical tracking system and the uplink system. It also unnecessarily exposes the launcher to threats during the mission.

Accordingly, a need exists in the art for an optically-guided type missile design offering improved performance at long range.

SUMMARY OF THE INVENTION

The need in the art is addressed by the optically-aided, inertially guided missile of the present invention. The inventive missile includes a receiver for accepting commands from a source (OGS) located on an independent frame of reference (missile launcher) relative to the missile and providing a first signal in response thereto. A filter is mounted on the missile for processing the first signal and providing a second signal in response thereto. The filter outputs correction commands to a navigation system which provides missile guidance commands in a conventional manner.

In the illustrative implementation, the filter is a Kalman filter configured to eliminate the effects of gunner jitter and optical guidance system noise thereby significantly improving missile terminal performance at long ranges. In the illustrative implementation, the navigation system includes an inertial sensor assembly. The navigation system outputs a signal representative of missile-to-target cross track position and velocity in response to outputs from the sensor assembly and the filter. The Kalman filter is also configured to calibrate and eliminate the inertial sensor assembly errors and the navigation cross track position and velocity errors. A guidance law is used by the system to compute missile acceleration commands in response to the missile-to-target cross track position and velocity. Thereafter, fin control commands are generated by an autopilot in response to the missile acceleration commands in a conventional manner.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
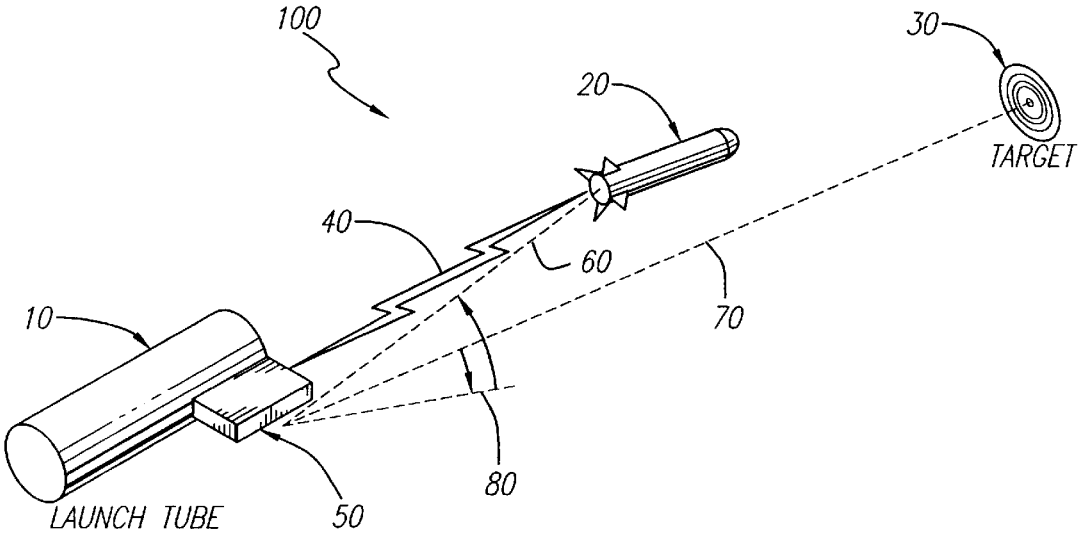
FIG. 1 is a diagram which illustrates the operation of a typical optically guided missile weapon system.

FIG. 1 is a diagram which illustrates the operation of a typical optically guided missile weapon system. The system 100 includes a launch tube (or launcher) 10 from which a missile 20 is launched in the general direction of a target 30. As mentioned above, the gunner typically places cross-hairs of an Optical Guidance System (OGS) 50 located on the launcher 10 onto the target and pulls the trigger. In fractions of a second, the missile 20 comes into the field-of-view of the OGS 50. At this point, tracking algorithms in the OGS 50 begin tracking the missile 20 and measuring the missile's angular displacement to the cross-hairs of the OGS 50. An angular displacement measurement is sent by the OGS 50 to the missile 20 via a radio link 40. An onboard guidance system and navigation system on the missile, receives the angular displacement measurement and computes a missile trajectory in accordance with a guidance law. An autopilot then guides the missile 20 to the target 30.

Figure 2:
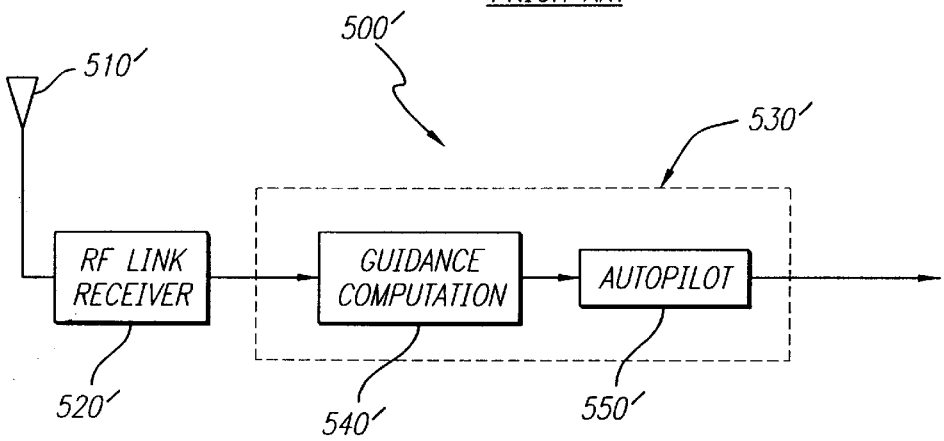
FIG. 2 PRIOR ART
FIG. 2 is a block diagram of a conventional guidance system mounted onboard an optically guided missile.

FIG. 2 is a block diagram of a conventional guidance system mounted onboard an optically guided missile. As shown in FIG. 2, the conventional onboard guidance system 500' includes an RF antenna 510', an RF receiver 520', and on onboard flight computer 530'. The receiver 520' outputs measured target-to-missile displacement angles, received and demodulated from the OGS 50, to the flight computer 530'. The computer 530' then computes a missile trajectory using a guidance law using software 540' and provides steering via an autopilot routine 550'. That is, the autopilot 550' receives missile acceleration commands from the guidance routine 540' and outputs fin commands to missile control fin actuators (not shown).

As mentioned above, conventional optical guidance systems such as that shown in FIG. 2 were designed for short missile standoff ranges. The accuracy of such missiles tends to degrade as range-to-target increases. This is due to the fact that a small angular error in the OGS measurement produces a large position error at long ranges. The angular measurement errors are caused by OGS boresight errors, as well as tracker noise and gunner motion. The OGS boresight errors are caused by optical misalignments and are expensive to abate. Consequently, weapon system performance of conventional optically missiles at long ranges is limited by the position error effects of OGS tracker noise and gunner motion. Unfortunately, longer standoff ranges will be required in the future and current guidance systems are not expected to meet the projected terminal guidance (miss distance) accuracy requirements of same.

Another drawback of the weapon systems described above is that the launcher has to continuously measure and uplink the line-of-sight measurements to the missile to ensure airframe stability and terminal performance. These systems have little tolerance for launcher dropouts. This imposes excessive burdens on the optical tracking system and the uplink system. It also unnecessarily exposes the launcher to threats during the mission.

Accordingly, a need exists in the art for an optically-guided type missile design offering improved performance at long range. The need in the art is addressed by the improved guidance system of the present invention.

Figure 3:
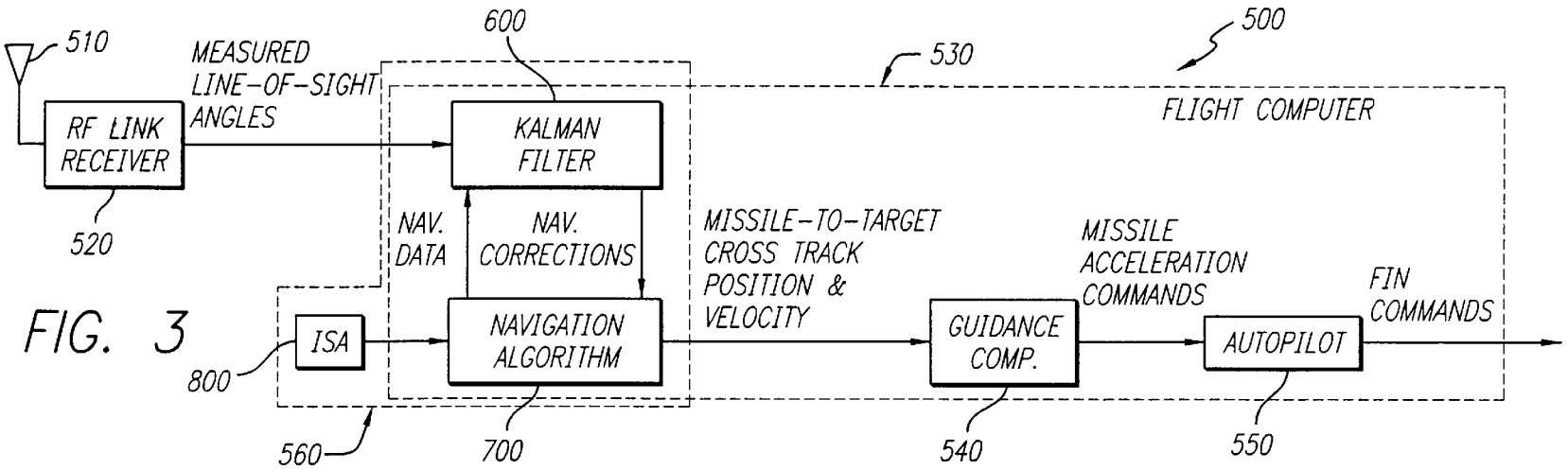
FIG. 3 is a block diagram of the improved missile guidance system of the present invention.

FIG. 3 is a block diagram of the improved missile guidance system of the present invention. The guidance system 500 of the present invention includes an antenna 510, an RF link receiver 520 and a flight computer 530 which performs guidance computations and autopilot functions as per the conventional system depicted in FIG. 2. However, in accordance with the present teachings, the inventive guidance system 500 further includes a navigation system 560 with a Kalman filter 600, a routine 700 which executes a navigation algorithm, and an inertial sensor assembly (ISA) 800 (often referred to as an 'inertial instrument' or 'inertial measurement unit' (IMU)). The Kalman filter 600 and the navigation routine 700 are adapted to be implemented by the flight computer 530.

As discussed more fully below, in the preferred embodiment, the Kalman filter is a ten state filter which receives measured line-of-sight angles from the RF link receiver 520 and navigation data from the ISA 800 via the navigation computation routine 700 and outputs navigation corrections to the navigation routine 700. The navigation routine maintains a three-dimensional target-to-missile inertial guidance reference position (position, velocity and altitude) that is initialized at launch. The navigation routine 700 outputs missile-to-target cross-track position and velocity data to the guidance routine 540 of the flight computer for further processing in a conventional manner.

The Kalman filter 600 weighs the reasonableness of the OGS measurements with the navigation estimates and prior knowledge of target velocity limits to correct the inertial reference errors and estimate inertial instrument biases. The missile 10 is then guided along the corrected 3-D inertial guidance reference to the target 30 (see FIG. 1). Unlike the conventional guidance system 500', the guidance system 500 of the present invention uses an inertial navigation system 560 to guide the missile directly with the OGS 50 used indirectly for course correction and inertial instrument (ISA) calibration.

Figure 4:
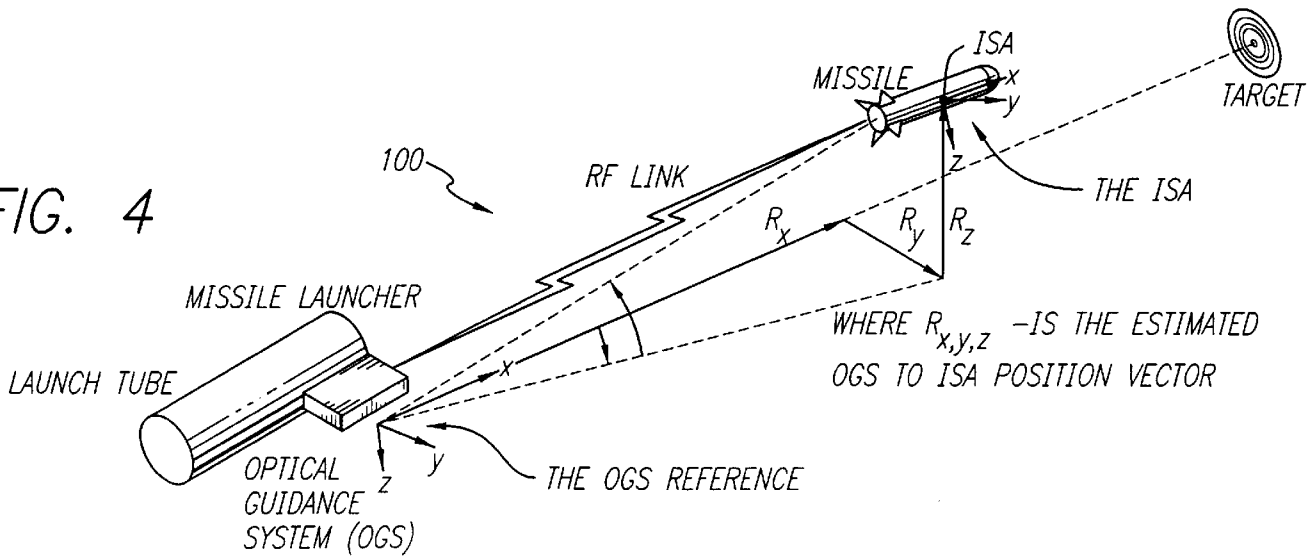
FIG. 4 is a diagram which illustrates the coordinate frames of the inertial guidance system utilized in an optically guided missile weapon system constructed in accordance with the present teachings.

FIG. 4 is a diagram which illustrates the coordinate frames of the inertial guidance system utilized in an optically guided missile weapon system constructed in accordance with the present teachings. In operation, the 3-D inertial guidance reference is assumed to be along the OGS reference as shown in FIG. 4 in which the reference numerals are identical to those of FIG. 1 and omitted for clarity. The navigation process of the present invention is as follows. Prior to launch the missile 20 is in the launch tube 10 and the OGS-to-ISA position and attitude is known within some uncertainty limits. This position and attitude is used to initialize the navigation system. Also prior to launch, the average missile launch velocity is used to initialize the navigation system. In flight, the navigation algorithm uses the ISA rate and acceleration measurements and well known navigation algorithm techniques (like quaternion algebra, direction cosines, matrix ortho-normalization and Adams-Bashforth Integration) to compute missile position, velocity and attitude relative to the OGS.

The estimated 3-D position, velocity and attitude reference are typically corrupted by initial alignment errors, initial missile velocity errors and ISA instrument biases. These errors cause the inertial reference to drift.

In accordance with the present teachings, the Kalman filter estimated position, velocity and attitude errors are used to correct the navigation system's cross-track positions, cross-track velocities and pitch and yaw attitudes. Also, the Kalman filter estimated ISA gyro biases are used to correct the ISA cross-track gyros measurements and the estimated accelerometer biases are used to correct the ISA cross-track accelerometer measurements. The missile is then guided along the x-axis of the 3-D reference to the target as shown in FIG. 4.

Figure 5:
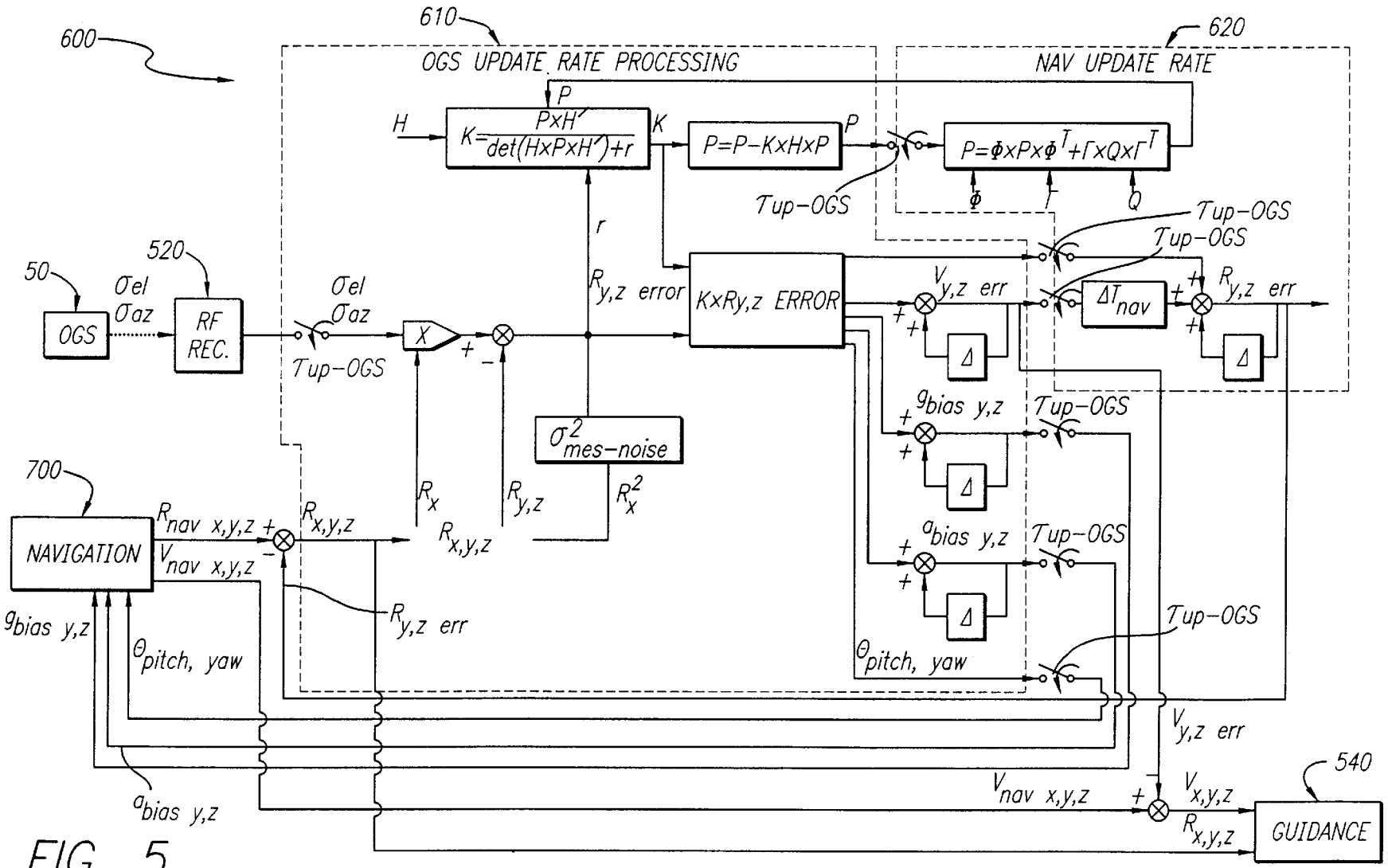
FIG. 5 is a diagram which illustrates the operation of the Kalman filter in accordance with the teachings of the present invention.

FIG. 5 is a diagram which illustrates the operation of the Kalman filter in accordance with the teachings of the present invention. In FIG. 5, the following definitions apply:

$\sigma_{el,az}$—OGS elevation and azimuth angular displacement measurement.

$\tau_{up\text{-}OGS}$—OGS measurement receive time (with OGS and Up Link delays).

$R_{nav\ x,y,z}$—Missile range vector from the launch point in nav frame.

$R_{x,y,Z}$—Corrected missile range vector.

$V_{x,y,z}$—Corrected missile velocity vector.

$\Delta T_{nav}$—Nav update rate.

$\Delta$—One frame delay.

$R_{y,z\ error}$—Cross-track position error residuals.

$R_{y,z\ err}$—Kalman Filter estimated cross-axis(y, z) range error.

$V_{y,z\ err}$—Kalman Filter estimated cross-axis(y, z) velocity error.

$a_{bias\text{-}y,z}$—Kalman Filter estimated y and z accelerometer biases.

$\theta_{pitch,\ yaw}$—Kalman Filter estimated pitch and yaw angle errors.

$g_{bias\text{-}y,z}$—Kalman Filter estimated pitch-gyro and yaw-gyro biases.

The ten states of the Kalman filter 600 are as follows:

$R_{y\ err}$—Estimated y-axis position error.

$R_{z\ err}$—Estimated z-axis position error.

$V_{y\ err}$—Estimated y-axis velocity error.

$V_{z\ err}$—Estimated z-axis velocity error.

$a_{bias\text{-}y}$—Estimated y-accelerometer bias.

$a_{bias\text{-}z}$—Estimated z-accelerometer bias.

$\theta_{pitch}$—Estimated pitch angle error.

$\theta_{yaw}$—Estimated yaw angle error.

$g_{bias\text{-}y}$—Estimated y-gyro bias.

$g_{bias\text{-}z}$—Estimated z-gyro bias.

The Kalman filter processes data at two rates as shown in FIG. 5. A State Covariance Matrix P is processed at the navigation update rate and the Kalman Gains K and Kalman States are processed asynchronously whenever the OGS measurement is received.

Figure 6:
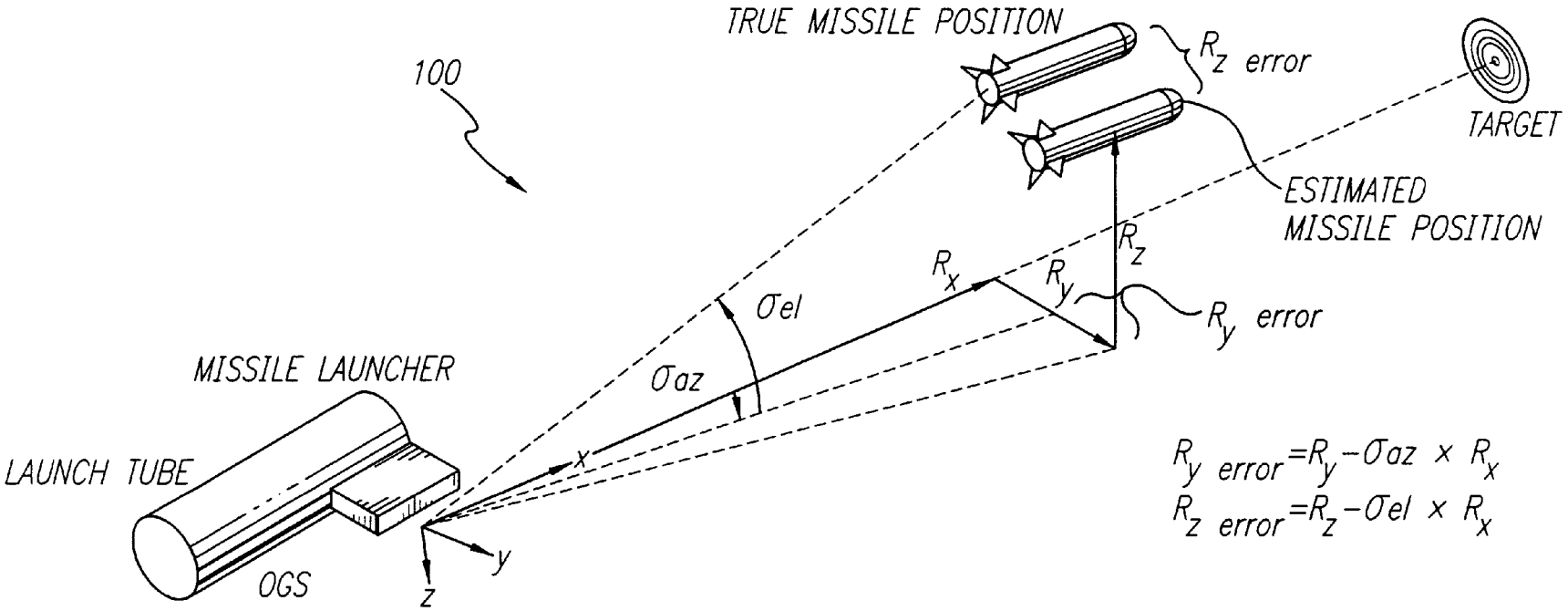
FIG. 6 is a diagram which illustrates the position error residuals eliminated by the inertial guidance system utilized in an optically guided missile weapon system constructed in accordance with the teachings of the present invention.

At every OGS measurement update the Kalman Filter 600 uses the navigation estimated OGS-to-ISA position vector and the OGS line-of-sight measurements to compute the position error residuals $R_{yz,\ error}$ in the manner shown in FIG. 6.

FIG. 6 is a diagram which illustrates the position error residuals eliminated by the inertial guidance system utilized in an optically guided missile weapon system constructed in accordance with the teachings of the present invention. In FIG. 6, the FIG. 6 is a diagram which illustrates the position error residuals eliminated by the inertial guidance system utilized in an optically guided missile weapon system constructed in accordance with the teachings of the present invention. following definitions apply:

Rx,y,z—Estimated OGS to ISA position vector.

σel,az—OGS measured elevation and azimuth angular displacements.

Ry,z error—Position error residual.

The State transition Matrix is computed as follows:

$$\Phi = \begin{bmatrix} 1 & 0 & \delta t & 0 & 0 & 0 & 0 & 0 & 0 & 0 \\ 0 & 1 & 0 & \delta t & 0 & 0 & 0 & 0 & 0 & 0 \\ 0 & 0 & 1 & 0 & C_{22}\delta t & C_{23}\delta t & 0 & -a_x\delta t & 0 & 0 \\ 0 & 0 & 0 & 1 & C_{32}\delta t & C_{33}\delta t & a_x\delta t & 0 & 0 & 0 \\ 0 & 0 & 0 & 0 & 1 & 0 & 0 & 0 & 0 & 0 \\ 0 & 0 & 0 & 0 & 0 & 1 & 0 & 0 & 0 & 0 \\ 0 & 0 & 0 & 0 & 0 & 0 & 1 & 0 & C_{22}\delta t & C_{23}\delta t \\ 0 & 0 & 0 & 0 & 0 & 0 & 0 & 1 & C_{32}\delta t & C_{33}\delta t \\ 0 & 0 & 0 & 0 & 0 & 0 & 0 & 0 & 1 & 0 \\ 0 & 0 & 0 & 0 & 0 & 0 & 0 & 0 & 0 & 1 \end{bmatrix}$$

where:

δt—Nav update rate interval.

$C_{ij}$—OGS to ISA Direction Cosine Matrix element i,j $a_x$—x-axis acceleration sensed by the x-accerlerometer.

The State Covariance Matrix is initialized as follows:

$$P = \begin{bmatrix} \sigma^2_{R\ err\text{-}y} & 0 & 0 & 0 & 0 & 0 & 0 & 0 & 0 & 0 \\ 0 & \sigma^2_{R\ err\text{-}z} & 0 & 0 & 0 & 0 & 0 & 0 & 0 & 0 \\ 0 & 0 & \sigma^2_{V\ err\text{-}y} & 0 & 0 & 0 & 0 & 0 & 0 & 0 \\ 0 & 0 & 0 & \sigma^2_{V\ err\text{-}z} & 0 & 0 & 0 & 0 & 0 & 0 \\ 0 & 0 & 0 & 0 & \sigma^2_{a\ bias\text{-}y} & 0 & 0 & 0 & 0 & 0 \\ 0 & 0 & 0 & 0 & 0 & \sigma^2_{a\ bias\text{-}z} & 0 & 0 & 0 & 0 \\ 0 & 0 & 0 & 0 & 0 & 0 & \sigma^2_{\theta\ pitch} & 0 & 0 & 0 \\ 0 & 0 & 0 & 0 & 0 & 0 & 0 & \sigma^2_{\theta\ yaw} & 0 & 0 \\ 0 & 0 & 0 & 0 & 0 & 0 & 0 & 0 & \sigma^2_{g\ bias\text{-}y} & 0 \\ 0 & 0 & 0 & 0 & 0 & 0 & 0 & 0 & 0 & \sigma^2_{g\ bias\text{-}z} \end{bmatrix}$$

Where: $\sigma_{R\ err\text{-}y}$—Range variance in y-axis at launch.

$\sigma_{R\ err\text{-}z}$—Range variance in z-axis at launch.

$\sigma_{V\ err\text{-}y}$—Velocity variance in y-axis at launch.

$\sigma_{V\ err\text{-}z}$—Velocity variance in z-axis at launch.

$\sigma_{a\ bias\text{-}y}$—Acceleration variance in y-axis at launch.

$\sigma_{a\ bias\text{-}z}$—Acceleration variance in z-axis at launch.

$\sigma_{\Theta\ pitch}$—Pitch attitude variance at launch.

$\sigma_{\Theta\ yaw}$—Yaw attitude variance at launch.

$\sigma_{g\ bias\text{-}y}$—Pitch rate variance at launch.

$\sigma_{g\ bias\text{-}z}$—Yaw rate variance at launch.

The measurement noise is set to the following:

$\sigma_{mes\text{-}noise}$—OGS angular measurement noise variance.

The Kalman Gain Matrix is as follows:

$$K = \begin{bmatrix} k_{1,1} & k_{1,2} \\ k_{2,1} & k_{2,2} \\ k_{3,1} & k_{3,2} \\ k_{4,1} & k_{4,2} \\ k_{5,1} & k_{5,2} \\ k_{6,1} & k_{6,2} \\ k_{7,1} & k_{7,2} \\ k_{8,1} & k_{8,2} \\ k_{9,1} & k_{9,2} \\ k_{10,1} & k_{10,2} \end{bmatrix}$$

The Measurement Matrix is as follows:

$$H = \begin{bmatrix} 1 & 0 & 0 & 0 & 0 & 0 & 0 & 0 & 0 & 0 \\ 0 & 1 & 0 & 0 & 0 & 0 & 0 & 0 & 0 & 0 \end{bmatrix}$$

The Process Noise is as follows:

$$\begin{bmatrix} q_{11} & 0 & 0 & 0 \\ 0 & q_{22} & 0 & 0 \\ 0 & 0 & q_{33} & 0 \\ 0 & 0 & 0 & q_{44} \end{bmatrix}$$

where: $q_{11}=q_{22}$—Velocity process noise variance
$q_{33}=q_{44}$—Attitude process noise variance
The Process Noise Matrix is as follows:

$$\Gamma = \begin{bmatrix} 0 & 0 & 0 & 0 \\ 0 & 0 & 0 & 0 \\ \delta t & 0 & 0 & 0 \\ 0 & \delta t & 0 & 0 \\ 0 & 0 & 0 & 0 \\ 0 & 0 & 0 & 0 \\ 0 & 0 & \delta t & 0 \\ 0 & 0 & 0 & \delta t \\ 0 & 0 & 0 & 0 \\ 0 & 0 & 0 & 0 \end{bmatrix}$$

where: δt—Nav update rate interval.

It is therefore intended by the appended claims to cover any and all such applications, modifications and embodiments within the scope of the present invention.

Accordingly,

What is claimed is:

1. An optically-aided, inertially guided type missile guidance system comprising:

receiver means located on the missile for receiving optically-aided commands from a source located on an independent frame of reference relative to the missile and providing a first signal in response thereto;

filter means mounted on said missile for processing said first signal and providing a second signal in response thereto; and an inertial sensor assembly mounted on said missile for providing missile guidance commands in response to said second signal.

2. The invention of claim 1 wherein said receiver means is a radio frequency receiver.

3. The invention of claim 1 wherein said filter means is a Kalman filter.

4. The invention of claim 3 wherein said filter is configured to eliminate position error effects of gunner jitter.

5. The invention of claim 3 wherein said filter is configured to eliminate position error effects of optical guidance system noise.

6. The invention of claim 1 wherein said navigation means includes means responsive to said sensor assembly and said filter means for outputting a signal representative of missile-to-target cross track position.

7. The invention of claim 6 wherein said navigation means includes means responsive to said sensor assembly and said filter means for outputting a signal representative of missile-to-target cross track position and velocity.

8. The invention of claim 7 wherein said navigation means further includes means responsive to said signal representative of missile-to-target cross track position and velocity for generating missile acceleration commands.

9. The invention of claim 8 wherein said navigation means further includes an autopilot responsive to said missile acceleration commands for generating fin commands.

10. An optically-aided, inertially guided type missile comprising:

a frame adapted to carry a payload;

a propulsion mechanism mounted on said frame;

a guidance mechanism for changing a velocity vector of said missile; and a guidance system, located on said frame for providing guidance commands to said guidance mechanism, said guidance system comprising:

receiver means for receiving commands from a source located on an independent platform and providing a first signal in response thereto;

a Kalman filter for processing said first signal and providing a second signal in response thereto; and an inertial sensor assembly for providing missile guidance commands in response to said second signal.

11. The invention of claim 10 wherein said receiver means is a radio frequency receiver.

12. The invention of claim 10 wherein said navigation means includes means responsive to said sensor assembly and said filter for outputting a signal representative of missile-to-target cross track position.

13. The invention of claim 12 wherein said guidance system includes means responsive to said sensor assembly and said filter for outputting a signal representative of missile-to-target cross track position and velocity.

14. The invention of claim 13 wherein said guidance system further includes means responsive to said signal representative of missile-to-target cross track position and velocity for generating missile acceleration commands.

15. The invention of claim 14 wherein said guidance system further includes an autopilot responsive to said missile acceleration commands for generating fin commands.

* * * * *